US009160111B2

(12) United States Patent
Hsu

(10) Patent No.: US 9,160,111 B2
(45) Date of Patent: Oct. 13, 2015

(54) FULLY EMBEDDED ELECTRONIC PLUG-IN CARD

(71) Applicant: Wen-Chi Hsu, New Taipei (TW)

(72) Inventor: Wen-Chi Hsu, New Taipei (TW)

( * ) Notice: Subject to any disclaimer, the term of this patent is extended or adjusted under 35 U.S.C. 154(b) by 71 days.

(21) Appl. No.: 14/079,058

(22) Filed: Nov. 13, 2013

(65) Prior Publication Data

US 2014/0162469 A1 Jun. 12, 2014

(30) Foreign Application Priority Data

Dec. 7, 2012 (TW) ..... 101223725 U

(51) Int. Cl.
*H01R 12/70* (2011.01)
*H01R 13/633* (2006.01)
*H01R 12/72* (2011.01)

(52) U.S. Cl.
CPC ..... *H01R 13/6335* (2013.01); *H01R 12/721* (2013.01); *H01R 13/633* (2013.01); *H01R 2201/06* (2013.01)

(58) Field of Classification Search
CPC ..... H01R 13/6335
See application file for complete search history.

(56) References Cited

U.S. PATENT DOCUMENTS

| | | | | |
|---|---|---|---|---|
| 4,747,790 | A * | 5/1988 | Masuda et al. | 439/631 |
| 7,374,104 | B2 * | 5/2008 | Aoki et al. | 235/492 |
| 2005/0054220 | A1 * | 3/2005 | Ge et al. | 439/76.1 |
| 2005/0059273 | A1 * | 3/2005 | Chiou et al. | 439/76.1 |
| 2006/0079133 | A1 * | 4/2006 | Kim | 439/630 |
| 2007/0267505 | A1 * | 11/2007 | Chen | 235/492 |
| 2007/0290050 | A1 * | 12/2007 | Chen | 235/492 |
| 2008/0316717 | A1 * | 12/2008 | Fernandez | 361/752 |
| 2009/0061688 | A1 * | 3/2009 | Aoki et al. | 439/628 |
| 2009/0063743 | A1 * | 3/2009 | Aoki et al. | 710/302 |
| 2013/0203297 | A1 * | 8/2013 | Lin et al. | 439/660 |
| 2014/0162469 | A1 * | 6/2014 | Hsu | 439/64 |
| 2014/0240910 | A1 * | 8/2014 | Yoon et al. | 361/679.02 |

* cited by examiner

*Primary Examiner* — James Harvey
(74) *Attorney, Agent, or Firm* — Chun-Ming Shih; HDLS IPR Services

(57) ABSTRACT

A fully embedded electronic plug-in card pluggable into a slot of a plug-in socket having a plurality of elastic guide arms includes a main body, a plurality of conductive plates and a recessed structure. The main body can be wholly plugged into the plug-in socket without protruding out from the plug-in socket. The conductive plate is mounted onto the main body, and exposed from a side of the main body, and each conductive plate is electrically coupled to each respective elastic guide arm. The recessed structure is disposed on the main body and at a position corresponding to the slot of the plug-in socket. The electronic plug-in card can be plugged into the plug-in socket all the time to save the trouble and inconvenience of plugging the card for use or unplugging the card for removal.

8 Claims, 4 Drawing Sheets

FULLY EMBEDDED ELECTRONIC PLUG-IN CARD

FIELD OF THE INVENTION

The present invention relates to an electronic plug-in card, and more particularly to a fully embedded electronic plug-in card.

BACKGROUND OF THE INVENTION

At present, electronic plug-in cards include memory cards plugged into a plug-in socket, and card type flash drives plugged into a universal serial bus (USB) plug-in socket.

To eject a present existing memory card from a plug-in socket, it requires a card eject mechanism of the plug-in socket to elastically eject the card, and thus increasing the cost due to the card eject mechanism. In addition, the complicated structure of the card eject mechanism may cause failure easily. After a present existing card type flash drive (referring to the flash drive with a card type connector) is plugged into a USB plug-in socket, a portion of the flash drive is protruded out of the USB plug-in socket, so that the total length of the present existing card type flash drives is longer than the USB plug-in socket, and the card type flash drive may be bent or broken by hitting the protruding portion. Particularly, if a card type flash drive is used in a portable electronic device, it requires plugging in the flash drive for use and removing the flash drive when the flash drive is not in use. Obviously, such troublesome and inconvenient application requires improvements.

In view of the aforementioned drawbacks of the prior art, the inventor of the present invention based on years of experience in the related industry to conduct extensive researches and experiments, and finally designed a fully embedded electronic plug-in card having a simple structure and capable of being ejected easily.

SUMMARY OF THE INVENTION

Therefore, it is a primary objective of the present invention to provide a fully embedded electronic plug-in card, wherein a main body is designed in such a way that the electronic plug-in card can be wholly plugged and embedded into the plug-in socket without any part protruding out from the plug-in socket, so that there is no risk of the electronic plug-in card being hit. The electronic plug-in card can be plugged in the plug-in socket all the time to save the trouble and inconvenience of plugging and unplugging the card. In addition, the recessed structure concavely disposed on the top side of the main body top side allows the electronic plug-in card to be pulled out from the recessed structure for removal.

To achieve the aforementioned objectives, the present invention provides a fully embedded electronic plug-in card to be plugged into a slot of a plug-in socket, and the plug-in socket contains a plurality of elastic guide arms, and the electronic plug-in card comprises: a main body, wholly plugged into the plug-in socket without protruding out from the plug-in socket; a plurality of conductive plates, mounted onto the main body, and exposed from a side of the main body, and each conductive plate being electrically coupled to each respective elastic guide arm; and a recessed structure, disposed on the main body and at a position corresponding to the slot of the plug-in socket.

Compared with the prior art, the present invention has the following effects:

With the fully embedded design and the special recessed structure, the electronic plug-in card can be plugged into a plug-in socket all the time without the need of worrying its being hit or collided, so as to save the trouble and inconvenience of plugging and unplugging the electronic plug-in card. In addition, the electronic plug-in card can be pulled out form the recessed structure for an easy removal.

DESCRIPTION OF THE PREFERRED EMBODIMENTS

The technical contents of the present invention will become apparent with the detailed description of preferred embodiments accompanied with the illustration of related drawings as follows. It is intended that the embodiments and figures disclosed herein are to be considered illustrative rather than restrictive.

Figure 3:
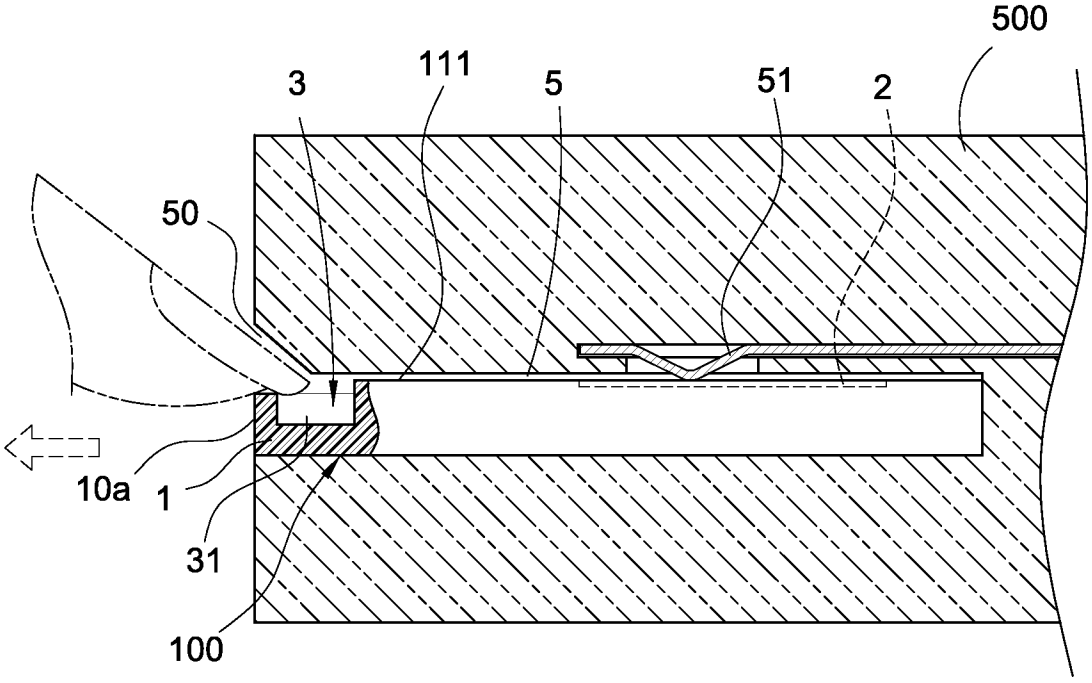
FIG. 3 is a sectional view of movements of the present invention after being plugged into a plug-in socket for use and pulled out by a nail for removal.

The present invention provides a fully embedded electronic plug-in card to be plugged into a plug-in socket 5 (as shown in FIG. 3) of an electronic device 500, and the plug-in socket 5 further includes a slot 50 and a plurality of elastic guide arms 51 in the plug-in socket 5, and the electronic plug-in card 100 of the present invention comprises a main body 1, a plurality of conductive plates 2 and a recessed structure 3.

Figure 1:
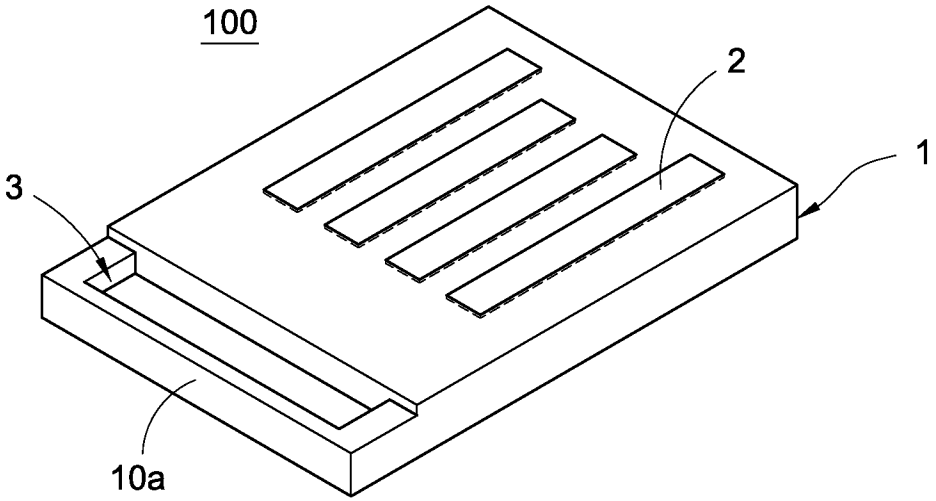
FIG. 1 is a perspective view of the present invention.
Figure 2:
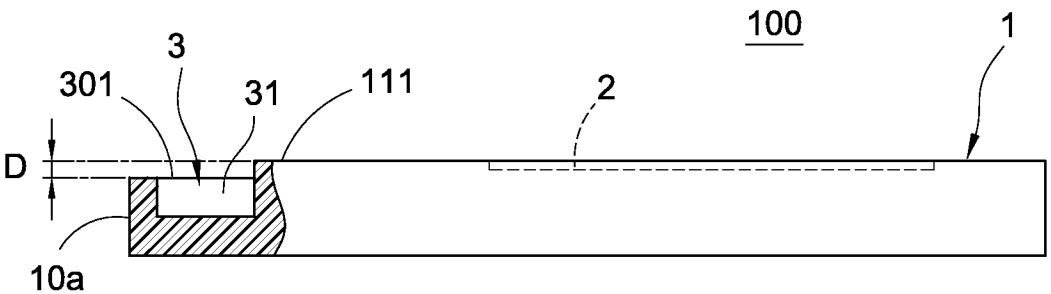
FIG. 2 is a sectional view of the present invention.

With reference to FIGS. 1 to 3 for a perspective vie and sectional view of the present invention and a sectional view of the present invention after being plugged into a plug-in socket 5 respectively, the conductive plate 2 is mounted onto the main body 1 and exposed from a top side 111 of the main body 1, and each conductive plate 2 is electrically coupled to each respective elastic guide arm 51, and the recessed structure 3 is also mounted onto the main body 1 and disposed at a position corresponding to the slot 50 of the plug-in socket 5.

The main body 1 is wholly plugged into the plug-in socket 5 (since the conductive plate 2 and the recessed structure 3 are disposed on the main body 1 and the total length of the electronic plug-in card 100 of the present invention is equal to the length of the main body 1, therefore the electronic plug-in card 100 of the present invention can be wholly plugged into the plug-in socket 5, and the main body 1 is used for illustrating the invention below). After the main body 1 is plugged without any portion protruded out from the plug-in socket 5, the main body 1 can be aligned evenly with the slot 50 of the plug-in socket 5 (as shown in the figures), or disposed inside the plug-in socket 5 (not shown in the figure). In other words, the length of the main body 1 of the former is equal to the plug-in socket 5, and the length of the main body 1 of the latter is smaller than the plug-in socket 5.

Figure 4:
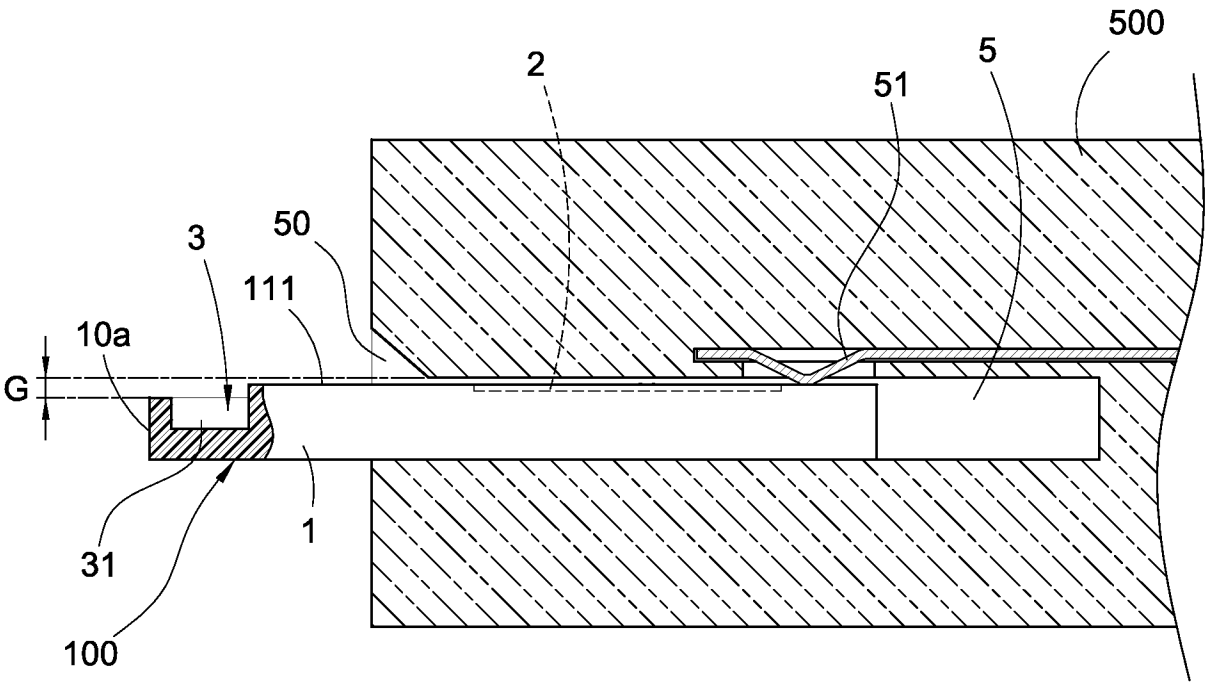
FIG. 4 is a sectional view of the present invention after the movements of FIG. 3 take place.

With reference to FIGS. 3 and 4 for a sectional view of the present invention being plugged into a plug-in socket 5, and then pulled by a nail for removal and a sectional view of the present invention after the aforementioned movements take place respectively, the recessed structure 3 is provided for being pulled by a nail of a human hand, a pen tip, or any other equivalent object. Since the electronic plug-in card 100 of the present invention is not protruded out from the plug-in socket 5, therefore there is no part available for users to grab for removing the plugged electronic plug-in card 100. With the recessed structure 3, a part is available for users to grab and pull the electronic plug-in card 100 out (as shown in FIG. 4). In particular, the recessed structure 3 is disposed at a position corresponding to the slot 50 of the plug-in socket 5 (or near the outer edge 10*a* of the main body 1) to facilitate a nail of a human hand, a pen tip or any equivalent object to extend from the slot 50 and pull the electronic plug-in card 100. In addition, the recessed structure 3 is formed on the main body 1 without increasing the total length, so that the electronic plug-in card 100 of the present invention still has a total length equal to the length of the main body 1, and the electronic plug-in card 100 will not protrude out from the plug-in socket 5 at all. After use, users do not have to worry about the electronic plug-in card 100 being hit or collided. In this preferred embodiment, the recessed structure 3 is a groove 31 formed at the top side 111 of the main body 1.

Since the top side 301 of the recessed structure 3 is lower than the top side 111 of the main body 1 (as indicated by the distance D of FIG. 2), therefore after the main body 1 is plugged into the plug-in socket 5 through the slot 50, there will be a gap G between the top side inside the plug-in socket 5 and the top side 301 of the recessed structure 3, so that a nail of a human hand, a pen tip or any equivalent object can be extended into the slot 50 to pull the electronic plug-in card out by using the recessed structure 3 for the removal.

Figure 5:
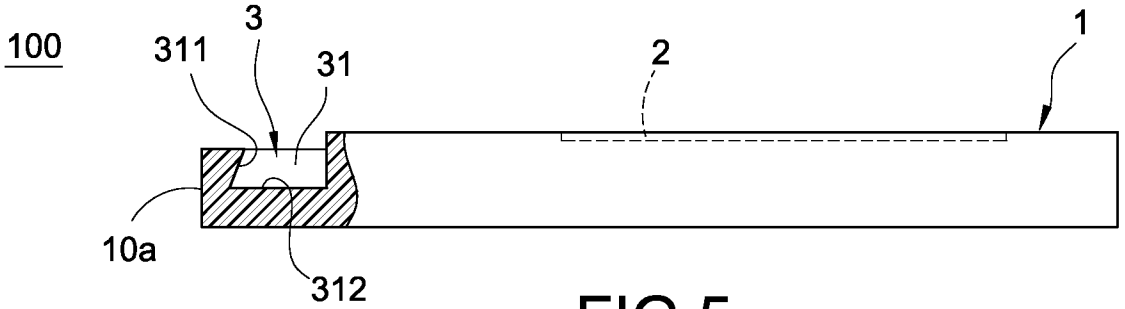
FIG. 5 is a sectional view of a second type of recessed structure of the present invention.
Figure 6:
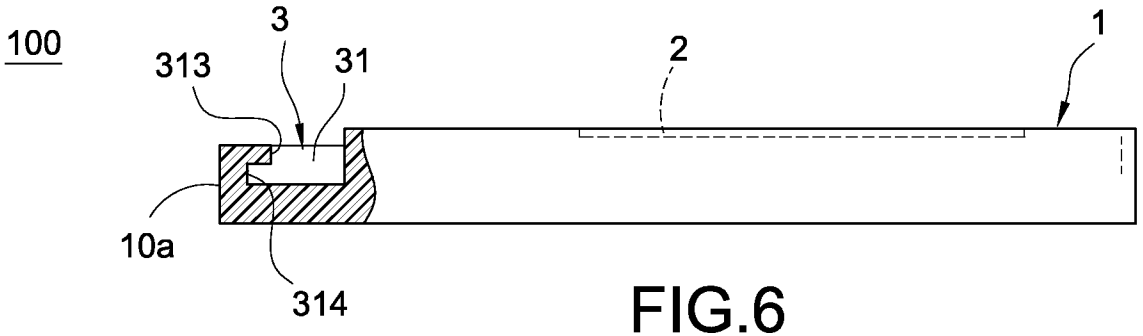
FIG. 6 is a sectional view of a third type of recessed structure of the present invention.

With reference to FIGS. 5 and 6 for sectional views of the second and third types of recessed structures 3 of the present invention respectively, FIG. 5 shows that an inner side 311 of the groove 31 proximate to the outer edge 10*a* of the main body 1 is inclined, and the inclination angle (which is the included angle between the inner side 311 and the groove bottom 312) is less than 90 degrees to facilitate the pulling effect. In FIG. 6, an auxiliary groove 314 is formed on an inner side 313 of the groove 31 proximate to the outer edge 10*a* of the main body 1 and communicated with the groove 31 to further facilitate the pulling effect.

The electronic plug-in card 100 of the present invention can be a memory card. After the memory card is plugged into the plug-in socket 5, the memory card is fully embedded into the plug-in socket 5. If it is necessary to eject the memory card, the recessed structure 3 is pulled in order to pull out the electronic plug-in card 100 as shown in FIGS. 3 and 4.

The electronic plug-in card 100 of the present invention also can be a card type flash drive or a card type wireless signal transmitter, wherein the so-called card type flash drive refers to a memory card type flash drive (unlike the present existing card type flash drive, which is a flash drive with a card type connector), and the so-called card type wireless signal transmitter can be a memory card type wireless signal transmitter, such as a card type Bluetooth transmitter. After the card type flash drive or the card type wireless signal transmitter is plugged into the plug-in socket 5, the card type flash drive or the card type wireless signal transmitter is fully embedded into the plug-in socket 5. If it is necessary to eject the memory card, the recessed structure 3 is pulled in order to pull out the electronic plug-in card 100 as shown in FIGS. 3 and 4.

Figure 7:
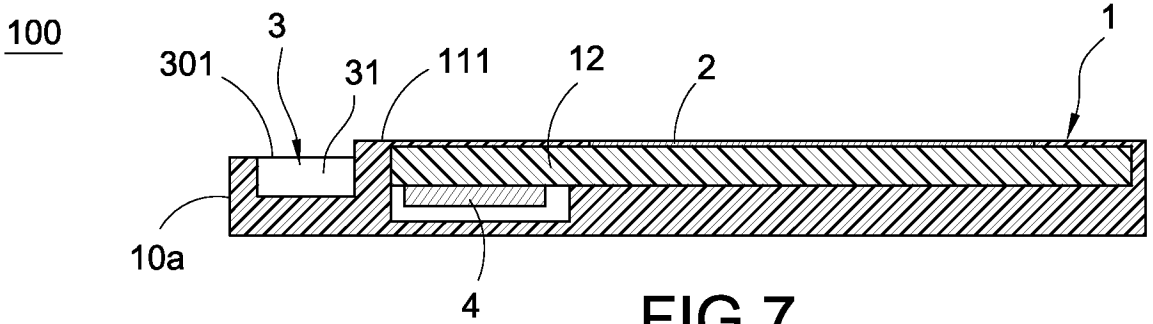
FIG. 7 is a sectional view of another preferred embodiment of the present invention.

With reference to FIG. 7, if the electronic plug-in card 100 of the present invention is a card type wireless signal transmitter (or a card type flash drive), the main body 1 includes a wireless signal transmission body (or a flash drive body 4) therein. In this preferred embodiment, the card type wireless signal transmitter is a card type Bluetooth transmitter, so that the wireless signal transmission body is a Bluetooth transmission body 4. More specifically, the main body 1 includes a substrate 12 cladded therein and electrically coupled to a Bluetooth transmission body 4 (or a flash drive body 4), and the conductive plate 2 is electrically coupled to the substrate 12, so that the conductive plate 2 is electrically conducted with the Bluetooth transmission body 4 (or the flash drive body 4). After the card type Bluetooth transmitter (or card type flash drive) is wholly plugged into the plug-in socket 5, the elastic guide arms 51 disposed in the plug-in socket 5 are electrically coupled to a conductive plate 13. If the electronic plug-in card 100 of the present invention is a card type flash drive, the flash drive body 4 integrated with the main body 1 comprises a USB control chip and a flash memory (not shown in the figure).

In summation of the description above, the present invention has the following advantages over the prior art: With the design of the main body 1 to be wholly plugged and embedded into the plug-in socket 5 without any portion protruding out from the plug-in socket 5, so that users do not have to worry about the electronic plug-in card being hit or collided, and the electronic plug-in card 100 of the present invention can be plugged into the plug-in socket 5 all the time, so as to save the trouble and inconvenience of plugging and unplugging the electronic plug-in card 100. With the recessed structure 3 concavely disposed on the top side 111 of the main body 1, users simply need to pull the recessed structure 3 with a hand grabbing portion available for the users to pull the electronic plug-in card 100 out from the plug-in socket 5 for the removal of the electronic plug-in card 100. Obviously, the plug-in socket 5 does not require the conventional complicated card eject mechanism or incur an additional cost for the card eject mechanism at all, and thus the invention not only reduces the cost and failure rate, but also waives the conventional card eject mechanism and reduces the total volume of the plug-in socket 5.

The present invention achieves the expected objectives and overcomes the drawbacks of the prior art, and the invention complies with patent application requirements, and is thus duly filed for patent application.

While the invention has been described by means of specific embodiments, numerous modifications and variations could be made thereto by those skilled in the art without departing from the scope and spirit of the invention set forth in the claims.

What is claimed is:

1. A fully embedded electronic plug-in card, being plugged into a slot of a plug-in socket, and the plug-in socket including a plurality of elastic guide arms installed therein, and the electronic plug-in card comprising:

a main body, wholly plugged into the plug-in socket without protruding out from the plug-in socket, having a bottom side and a top side opposite to the bottom side;

a plurality of conductive plates, mounted onto the main body, and exposed from a first surface of the top side of the main body, and each conductive plate being electrically coupled to each respective elastic guide arm; and a recessed structure, disposed on a second surface of the top side of the main body and at a position corresponding to the slot of the plug-in socket, wherein the second surface has a level with respect to a surface of the bottom side lower than that of the first surface.

2. The fully embedded electronic plug-in card of claim 1, which is a memory card.

3. The fully embedded electronic plug-in card of claim 1, wherein the recessed structure is a groove.

4. The fully embedded electronic plug-in card of claim 3, wherein an inner side of the groove proximate to the outer edge of the main body is inclined.

5. The fully embedded electronic plug-in card of claim 4, wherein the inner side of the groove and a groove bottom of the groove form an included angle less than 90 degrees.

6. The fully embedded electronic plug-in card of claim 3, wherein the groove includes a first groove on the second surface and a second groove extended from a lateral side of the first groove proximate to an outer edge of the main body.

7. The fully embedded electronic plug-in card of claim 1, wherein the main body has a length equal to the plug-in socket.

8. The fully embedded electronic plug-in card of claim 1, wherein the main body has a length smaller than the plug-in socket.

* * * * *